US007971759B2

(12) United States Patent
Dalan et al.

(10) Patent No.: US 7,971,759 B2
(45) Date of Patent: Jul. 5, 2011

(54) AEROSOL CONTAINER WITH PRESSURE RELIEF MECHANISM

(75) Inventors: Roger Dalan, Mt. Vernon, WA (US); Tom Nicoletto, Elburn, IL (US); Joe Koch, Sycamore, IL (US)

(73) Assignee: DS Containers, Inc., Batavia, IL (US)

( * ) Notice: Subject to any disclaimer, the term of this patent is extended or adjusted under 35 U.S.C. 154(b) by 399 days.

(21) Appl. No.: 12/195,175

(22) Filed: Aug. 20, 2008

(65) Prior Publication Data

US 2010/0044399 A1 Feb. 25, 2010

(51) Int. Cl.
*B65D 83/00* (2006.01)

(52) U.S. Cl. ..... 222/397; 222/402.1; 137/68.27; 220/89.2

(58) Field of Classification Search ..... 222/396–397, 222/541.3, 541.4, 541.6, 402.1; 137/68.27, 137/910, 68.25, 68.23, 68.11; 220/89.1, 220/89.2, 203.08, 624, 367.1, 368
See application file for complete search history.

(56) References Cited

U.S. PATENT DOCUMENTS

| | | | | | |
|---|---|---|---|---|---|
| 2,795,350 | A * | 6/1957 | Lapin | 220/203.08 |
| 3,731,838 | A * | 5/1973 | Gedde | 220/623 |
| 3,831,822 | A * | 8/1974 | Zundel | 222/397 |
| 4,003,505 | A * | 1/1977 | Hardt | 222/397 |
| 4,513,874 | A * | 4/1985 | Mulawski | 220/89.2 |
| 4,576,303 | A * | 3/1986 | Mundt et al. | 220/89.2 |
| 4,580,690 | A * | 4/1986 | Mulawski | 220/89.2 |
| 4,588,101 | A * | 5/1986 | Ruegg | 220/89.2 |
| 4,610,370 | A * | 9/1986 | Patterson et al. | 220/203.08 |
| 4,722,874 | A * | 2/1988 | Marchak | 429/56 |
| 4,928,844 | A * | 5/1990 | LaBarge | 220/203.08 |
| 5,042,675 | A * | 8/1991 | Patterson | 220/89.1 |
| 5,121,858 | A * | 6/1992 | Chong | 222/397 |
| 5,197,622 | A * | 3/1993 | Anderson | 220/89.2 |
| 7,222,757 | B2 * | 5/2007 | Ferreira et al. | 222/397 |
| 7,621,166 | B2 * | 11/2009 | Ferreira et al. | 72/347 |

FOREIGN PATENT DOCUMENTS

| | | |
|---|---|---|
| CH | 540170 | 9/1973 |
| EP | 1785371 | 5/2007 |

* cited by examiner

*Primary Examiner* — Frederick C. Nicolas
(74) *Attorney, Agent, or Firm* — Polster, Lieder Woodruff & Lucchesi, LC

(57) ABSTRACT

An aerosol container (10) dispenses a fluid product under pressure. A pressure relief mechanism (30) vents the container in a controlled manner when the container is subjected to excessive pressure so to prevent the container from bursting. The container has a container body (12) of a hollow, generally cylindrical shape. Pressurized contents of the container are expelled through a valve assembly (18) installed at one end of the container. An end piece (22) attached to the container body at the other end of the container has a first circular shaped section (26) surrounded by a ring shaped outer section (28). The pressure relief mechanism comprises U-shaped score lines (32) formed across the transition between the two sections of the end piece. These score lines create lines of weakness in the material from which the end piece is made for the end piece to fracture along the score lines when the pressure within the container exceeds a predetermined pressure level. This allows the container to vent a controlled manner rather than burst.

10 Claims, 2 Drawing Sheets

AEROSOL CONTAINER WITH PRESSURE RELIEF MECHANISM

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

This invention relates to aerosol containers; and more particularly, to an aerosol container having a pressure relief mechanism on the bottom of the container.

As is known in the art, aerosol containers are made of a metal, typically steel, and are used to store a product, under pressure, and then dispense the product, typically in the form of a foam or a spray. Such containers are either of a two-piece or a three-piece construction and include a body comprising a hollow cylinder and end pieces. In a two piece container, the cylinder is closed at one end and an end piece is attached to the other, open end of the container with a circumferential seam, usually a double seam, formed about the periphery of the two pieces to join them together. In a three-piece container, the cylinder is open at both ends and with end pieces attached to the respective ends of the cylinder, again by seaming. The cylinder of the container is filled with both a product to be dispensed from the container, and a propellant for expelling the product. A valve assembly is carried by an end piece and, when activated, the product is dispensed through a valve of the assembly.

The product and propellant are held under pressure in the container. The double seam forms a mechanical joint between the two parts of the container. If the container is subjected to a pressure which exceeds its design limits, the seam will come apart (release) before the container body splits open. The container will then be said to have "burst" and the potential energy stored within the container is converted into kinetic energy and released. When this happens, there can be a sudden and energetic release of the bottom end piece of a container from the container.

One way to prevent a can from bursting is to vent the pressure before the container bursts. In this regard, it is known that one way to provide the pressure relief to vent a container is to inscribe a score mark or line somewhere on the container so to form an area of reduced thickness, or weakness in the container wall, which will give when the internal container pressure exceeds some pressure limit. In U.S. Pat. No. 3,850,339, for example, a pressure relief system for containers includes a plurality of scoring marks formed in the seam where the container body and valve end of the container are joined together. When the internal pressure in a filled container exceeds the pressure limit, the periphery of this top closure buckles outwardly causing fracturing that produces a plurality of vents. This allows the contents of the container to safely escape and prevent the end of the container from blowing-off.

More recently, U.S. Pat. No. 7,222,757 describes a container in the base of which an arcuately shaped score line is made. This score line produces an area of reduced thickness in the bottom wall of the container which fractures when the container is subjected to an over-pressure, again allowing the container to vent its contents to the atmosphere rather than bursting.

While effective for its intended purpose, the constructions shown in these patents are not applicable to all aerosol container constructions.

BRIEF SUMMARY OF THE INVENTION

The present disclosure is directed to an aerosol container having a score lines inscribed about a base of the container to create areas of weakness in the base. The score lines will cause the container to fracture and vent its contents when subjected to excessive pressures, rather than bursting. A bottom end piece of the container has a generally domed shape with a circular center section surrounded by an outer ring shaped section. A plurality of arcuate shaped score lines are inscribed in a rounded, shoulder portion of the outer ring shaped section and the center section of the end piece. Each scores line comprises a general U-shape whose open end points toward the center section of the end piece. In one embodiment, the score lines are equidistantly spaced about the bottom of the container and form lines of reduced thickness in the bottom wall of the container. When the container is subjected to an internal pressure exceeding its design limit, the bottom end piece everts and the area defined by the score lines fracture and split open, creating vents in the bottom of the container. Importantly, this rupturing occurs in a controlled fashion by which the contents of the container are safely released.

A variety of patterns of score lines are used depending upon the contents of the container and the venting pressure at which these contents are to be released. Other factors determining how pressure relief is controlled is the contour of the dome shaped bottom end piece of the container, including flattening an area of the center section of this end piece.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DESCRIPTION OF THE PREFERRED EMBODIMENT

Figure 1:
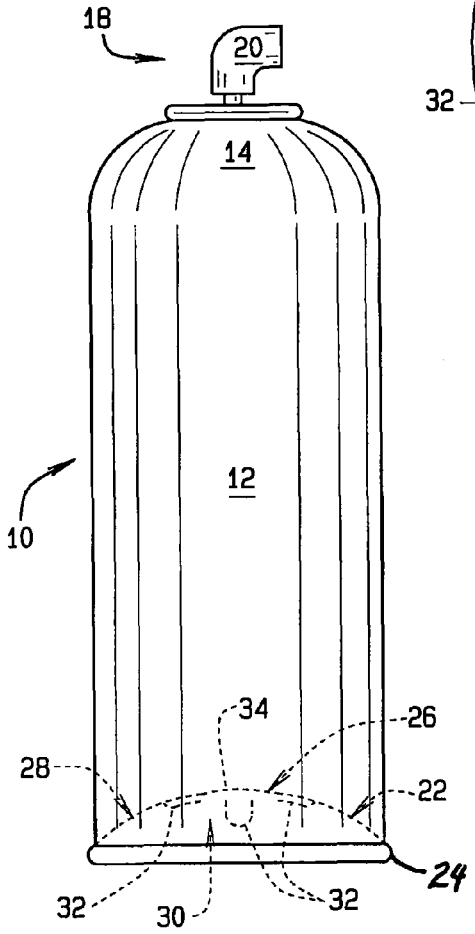
FIG. 1 is an elevation view of a two-piece pressurized aerosol container with pressure relief for venting the container so it does not burst.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a two-piece aerosol container 10 is a metal container filled with a fluid product to be dispensed. The contents of the container are under pressure and the container includes a propellant for dispensing the product. Container 10 includes a container body 12 which is of a hollow, cylindrical shape. The container body is formed from a rolled steel, PET polymer coated on both sides, initially made to a TH340 temper, and 0.23 mm (0.009") thick. The body is a seamless body nominally 2 11/16" in diameter and necked down to a diameter of 2 9/16" (209) at the bottom in order to accept the end piece attached to complete the container assembly. The mechanical properties of the metal include a 38 ksi yield strength, a 52 ksi tensile strength, and a minimum elongation of 30%.

The top, or dome portion, of container body 12 carries a valve assembly 18 including a valve 20 through which the product is dispensed when the valve is opened, typically by the user exerting finger pressure on the valve. A base or bottom end piece, generally indicated 22, is attached to the other end of the container body by a double seam 24. This end piece is made from a rolled steel, PET polymer coated on both sides, with an initial temper of TH435, 0.35 mm (0.138") thick. The end piece has a nominal diameter of 2 9/16" (209). The mechanical properties of the end piece metal, as received, are a 64 ksi yield strength, a 68 ksi tensile strength, and a minimum elongation of 20%.

Figure 3:
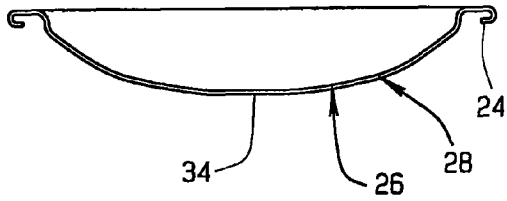
FIG. 3 is a cross-sectional view of the end piece taken along line 3-3 in FIG. 2, and the profile and contour of the end piece; and, FIGS. 4 and 5 illustrate other pressure relief configurations.

In accordance with the invention, end piece 22 includes a pressure relief mechanism, indicated generally 30, which provides for a controlled venting of container 10 in instances of over-pressurization such as are caused, for example, by elevated temperatures. As shown in FIG. 3, the end piece is generally inwardly dome shaped and includes a generally circular center section 26 which is surrounded by an outer ring section 28. As shown by the contour profile in FIG. 3, center section 26 of end piece 22 has a radius of approximately 2.807", while the radius of ring section 28 is approximately 1.836". The intersection of the two dome radii occurs at a center radius of approximately 0.896", with the area inscribed within this radius comprising a center panel of the end piece.

Figure 2:
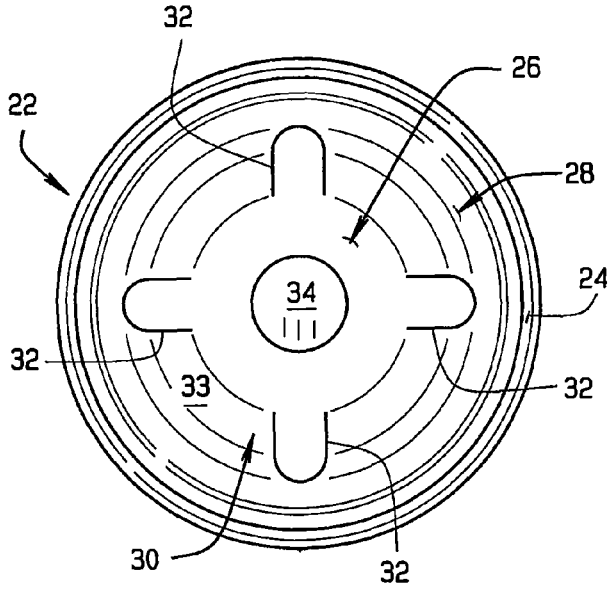
FIG. 2 is a plan view of a bottom end piece of the container.
Figure 4:
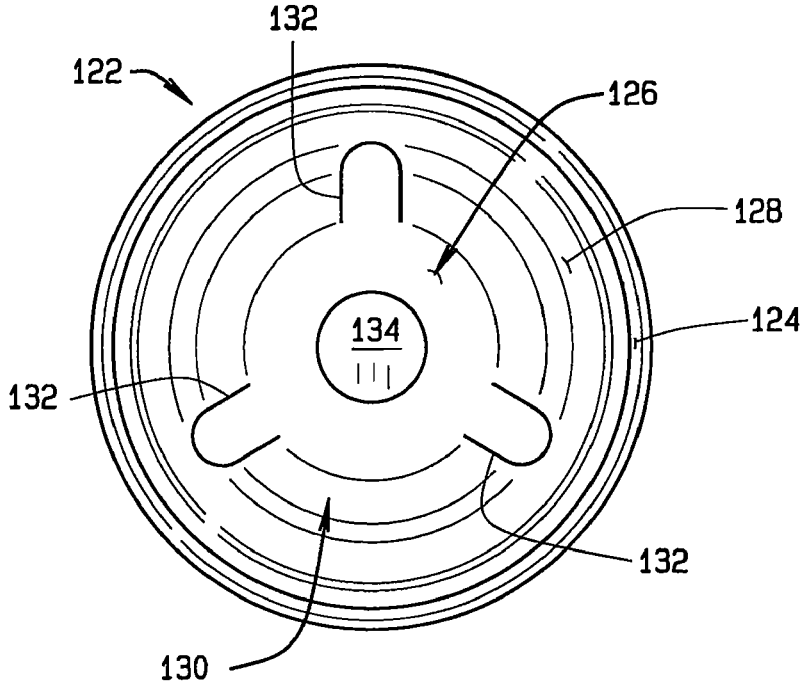
Figure 5:
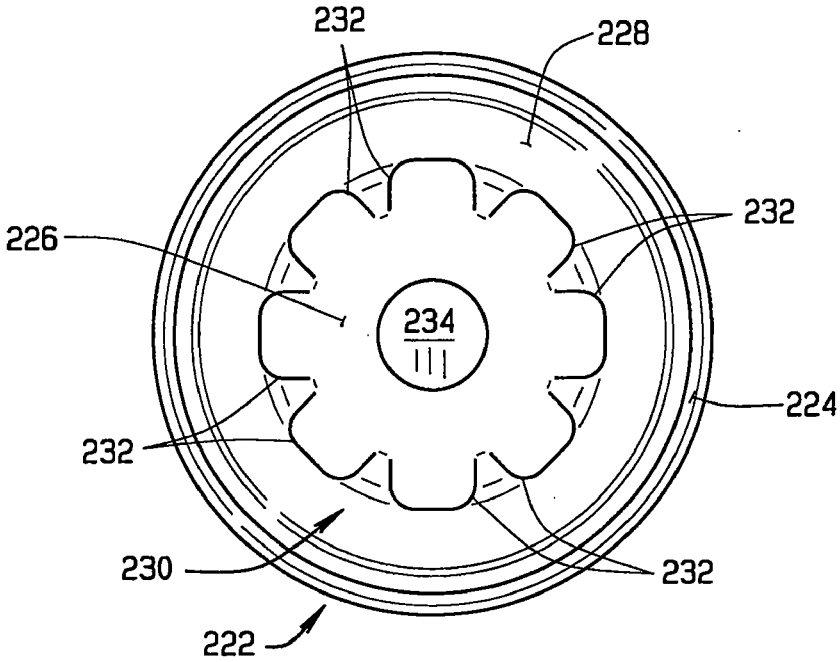

Pressure relief mechanism 30 comprises at least one, and preferably a plurality of arcuately shaped score lines 32 inscribed in a rounded, shoulder portion of outer ring shaped section 28 of end piece 22, adjacent center section 26 of the end piece. As shown in FIG. 2, each score line is generally U-shaped with the open end of the "U" extending across the transition between first section 26 and second section 28 of the end piece; i.e., it spans the transition of the two dome radii of the end piece. The score lines 32 are arranged in a predetermined pattern about the end piece, and in the embodiment shown in FIG. 2, there are four U-shaped score lines 32, placed 90° apart. Other arrangements of the score lines are shown in FIGS. 4 and 5 and are described hereinafter.

The dimensions of the score lines 32 shown in the FIG. 2 embodiment are such that each score feature has a center line dimension of approximately 0.15755", terminating in a radius, so to form the "U" shape. Each leg of the "U" extends approximately 0.2000" beyond the center point of the "U" which is located approximately 0.8500" from the end. The cross section of each score line 32 is such that its cutting edge is approximately 0.00150" in width. The included angle of a score line's base is approximately 70°, and the overall height of the score line is approximately 0.0120". The open end of each "U" is finished off with a radial grind set at approximately 35° from vertical, thereby creating a radius of approximately 0.00075" and closing off the end of the score line. After the score lines are formed, the thickness of laminated end piece 22, where the score lines are formed, is approximately 0.007" to 0.008".

It will be understood by those skilled in the art that the purpose of pressure relief mechanism 30 is to influence the pressure at which the end piece 22 everts, this eversion causing the scores lines 32 to fracture, rupturing the container and venting its contents. This action is important because it prevents the container from bursting and possibly causing harm to people and damage to other objects.

The number, size, and shape of the score lines 32 allow pressure relief mechanism 30 to be designed such that containers containing different types of contents will vent at different levels of over-pressure. It further allows the pressure relief mechanism to be effectively used with other size containers beside those having the 209 diameter end described herein. To further help control the pressure level at which venting occurs, a portion of center section 26 of end piece 22 is flattened as indicated at 34. In the embodiment of end piece 22 shown in FIG. 2, the flattened portion 34 of section 26 is shown to be rounded, centered on the end piece, and having a diameter of approximately 0.575". It will be understood by those skilled in the art that a greater or lesser sized area of section 26 can be flattened to further calibrate pressure relief mechanism 30 or the end pieces used on other size containers.

The score lines 32 of pressure relief mechanism 30, as noted, provide a controlled venting of container 10 at pressures in excess of, for example, 180 psi. When a fluid product with which container 10 is filled reaches this pressure, due to the filled container being overheated, or to other unusual conditions, end piece 22 everts, and the contour or profile of the end piece changes from an inwardly extending dome to an outwardly extending dome. Coincident with this change, one or more of the "U" shaped score lines 32 rupture, venting container 10 in a controlled fashion. It has been found that immediately after end piece 22 everts and venting occurs, if all four score lines 32 have ruptured, the flow rate from container 10 is approximately 4 SCFM through the now open vents.

To prove the strength of the double seam 24, end pieces were made identically to the end pieces 22, but without the four score lines 32 of pressure relief mechanism 30. Containers made using these end pieces were tested hydrostatically. It was found that the containers would buckle at pressures in excess of 180 psi and that they would remain attached to the can bodies until an average pressure of 357 psi was reached.

Referring to FIGS. 4 and 5, other embodiments of the pressure relief mechanism are shown. In FIG. 4, an end piece 122 includes a generally circular center section 126 surrounded by an outer ring section 128. The end piece is attached to a container body by a seam 124. A pressure relief mechanism 130 includes three "U" shaped score lines 132 which are spaced 120° apart. The width of these score lines is narrower than the score lines 32 and the score lines 132 are longer than the score lines 32. Center section 126 of end piece 122 also has a flattened center area 134 which is larger in diameter than the area 34 of end piece 22.

Referring to FIG. 5, an end piece 222 includes a generally circular center section 226 surrounded by an outer ring section 228. End piece 222 is attached to a container body by a double seam 224. Now, a pressure relief mechanism 230 includes eight "U" shaped score lines 232 which are spaced 45° apart. The width of these score lines is wider than the score lines 32 of end piece 22 and the score lines 232 are shorter than the score lines 32. Center section 226 of end piece 222 has a flattened center area 234 which is smaller in diameter than the area 34 of end piece 22.

Those skilled in the art will understand that other implementations of pressure relief mechanism 30 are possible within the scope of the invention. It will be appreciated, for example, that the depth of the score lines cut into an end piece can be other than that described above with respect to the embodiment shown in FIG. 2. It will be further appreciated that while the above description is with respect to a standard 209 aerosol container, the pressure relief mechanism can also be readily implemented on other standard size aerosol containers, as well as non-standard size containers.

In view of the above, it will be seen that the several objects and advantages of the present disclosure have been achieved and other advantageous results have been obtained.

Having thus described the invention, what is claimed and desired to be secured by Letters Patent is:

1. In an aerosol container for dispensing a fluid product under pressure, a pressure relief mechanism for venting the container when it is subjected to an excessive pressure so to prevent the container from bursting, the container comprising:

a container body of a hollow cylindrical shape, a valve assembly installed at one end of the container through which the pressurized contents of the container are expelled;

an end piece attached to the container body at the other end of the container, the end piece having a first section of a first contour and a second section of a second contour surrounding the first section, the pressure relief mechanism comprising at least one score line formed across the transition between the first and second sections, the score line creating a line of weakness in the material from which the end piece is made for the end piece to fracture along the score line when the pressure within the container exceeds a predetermined pressure level to thereby vent the container in a controlled manner so that the container does not burst, the end piece being dome shaped with the first section of the end piece defined by a first radius and the second section thereof by a second and different radius, and the first section comprising a circular section having a flattened portion formed therein and the second section being ring shaped; and, a plurality of score lines formed at the transition between the first and second sections so to provide a plurality of lines of weakness in the material so to facilitate venting of the container.

2. The pressure relief mechanism of claim 1 in which the score lines are spaced about the end piece in a predetermined pattern.

3. The pressure relief mechanism of claim 2 in which the score lines are equidistantly spaced about the end piece.

4. The pressure relief mechanism of claim 1 in which each score line is U-shaped with the U being spanning the transition of the two dome radii of the end piece.

5. The pressure relief mechanism of claim 4 in which the number, size, and location of the U-shaped score lines influence the pressure at which the end piece fractures and the rate at which the container vents.

6. The pressure relief mechanism of claim 5 in which the pressure at which the end piece fractures is further influenced by the size of the flattened portion of the circular section of the end piece.

7. An aerosol container having pressure relief comprising:

a container body of a hollow cylindrical shape;

a valve assembly installed at one end of the container through which pressurized contents of the container are expelled;

an end piece attached to the container body at the other end of the container, the end piece being generally dome shaped with a first circular section of a first radius and a second ring shaped section of a second and different radius surrounding the first section, the first section of the end piece having a flattened portion formed therein with the pressure at which the end piece fractures being influenced by the size of the flattened portion; and, a pressure relief mechanism comprising at least one score line formed on a center panel of the end piece, the score line creating a line of weakness in the material from which the end piece is made for the end piece to fracture along the score line when the pressure within the container exceeds a predetermined pressure level to thereby vent the container in a controlled manner so that the container does not burst, the pressure relief mechanism comprising a plurality of score lines formed on the center panel so to provide a plurality of lines of weakness in the material and facilitate venting of the container, the score lines being equidistantly spaced about the second section of the end piece in a predetermined pattern, each score line being U-shaped and formed in the second section of the end piece with the open end of the U extending across an outer margin of the first section thereof, the number, size, and location of the U-shaped score lines also influencing the pressure at which the end piece fractures, and the rate at which the container vents.

8. An aerosol container having pressure relief comprising:

a container body of a hollow cylindrical shape;

a valve assembly installed at one end of the container through which pressurized contents of the container are expelled;

an end piece attached to the container body at the other end of the container, the end piece being generally dome shaped with a first circular section of a first radius and a second ring shaped section of a second and different radius surrounding the first section, the first section of the end piece having a flattened portion formed therein and the pressure at which the end piece fractures being influenced by the size of the flattened portion; and, a pressure relief mechanism comprising a plurality of U-shaped score lines formed on a center panel of the end piece, each score line creating a line of weakness in the material from which the end piece is made for the end piece to fracture along the score line when the pressure within the container exceeds a predetermined pressure level to thereby vent the container in a controlled manner so that the container does not burst, and the number, size, and location of the U-shaped score lines further influencing the pressure at which the end piece fractures and the rate at which the container vents.

9. The container of claim 8 in which the open end of each U-shaped score line lies across the transition between the two dome radii of the end piece.

10. The container of claim 8 in which the score lines are equidistantly spaced about the second section of the end piece in a predetermined pattern.

* * * * *